United States Patent [19]

Pfefferle et al.

[11] 4,073,716

[45] Feb. 14, 1978

[54] PROCESS FOR PRODUCING SYNTHETIC NATURAL GAS AND HIGH OCTANE MOTOR FUEL COMPONENTS

[75] Inventors: William C. Pfefferle, Middletown; William P. Hettinger, Jr., Mountainside, both of N.J.

[73] Assignee: Engelhard Minerals & Chemicals Corporation, Iselin, N.J.

[21] Appl. No.: 629,858

[22] Filed: Nov. 7, 1975

[51] Int. Cl.[2] ..... C10G 13/30; C10G 39/00

[52] U.S. Cl. ..... 208/66; 48/197 R; 48/213; 208/64; 208/65

[58] Field of Search ..... 208/62, 63, 66, 64, 208/65; 48/197 R, 213

[56] References Cited

U.S. PATENT DOCUMENTS

| | | | |
|---|---|---|---|
| 2,983,667 | 5/1961 | Munns et al. | 208/66 |
| 3,481,722 | 12/1969 | Pfefferle | 48/197 R |
| 3,825,487 | 7/1974 | Wilhelm | 48/197 R |
| 3,849,290 | 11/1974 | Wise et al. | 208/66 |
| 3,899,411 | 8/1975 | Bonacci et al. | 208/66 |

*Primary Examiner*—Herbert Levine

[57] ABSTRACT

Synthetic natural gas and high octane motor fuel blending stock is produced by catalytically reforming naphtha at low severity to maximize production of aromatics and minimize hydrocracking, and then converting the remaining paraffins to methane in a methanation zone. The effluent from the methanation zone is separated into synthetic natural gas and motor fuel blending stock.

9 Claims, 2 Drawing Figures

Figure 1:
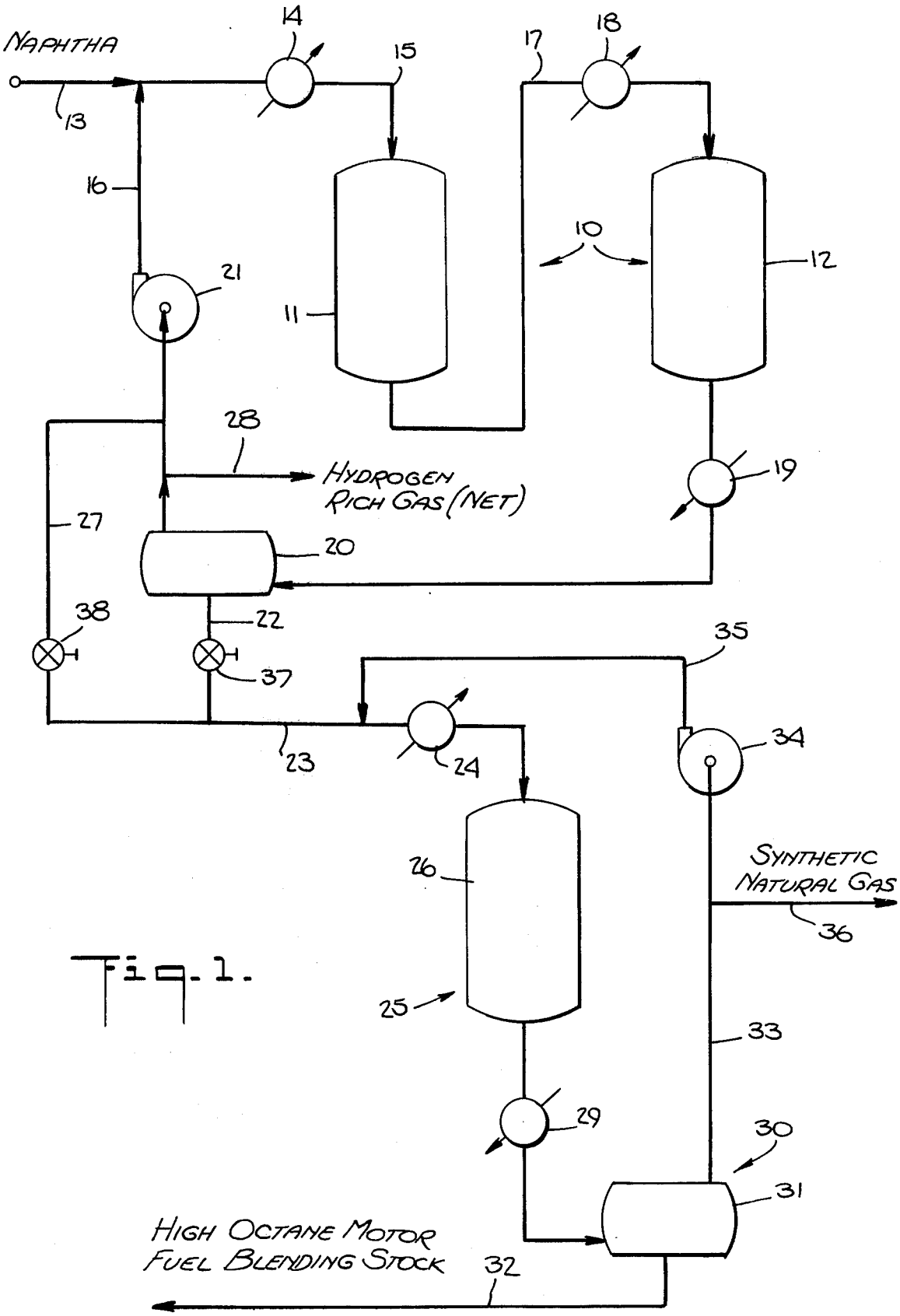

PROCESS FOR PRODUCING SYNTHETIC NATURAL GAS AND HIGH OCTANE MOTOR FUEL COMPONENTS

This invention relates to a combination process for concurrently producing a synthetic natural gas and high octane motor fuel blending stock. More particularly, the invention relates to reforming a naphtha under low severity reforming conditions to obtain a low octane reformate and then methanating such low octane reformate to obtain a high octane motor fuel stock and a synthetic natural gas stream of pipeline quality comprising essentially methane.

For many years naphtha reformate has been a conventional component of automotive motor fuel (gasoline). Typically, the reformate has been produced by forming a naphtha in the presence of hydrogen and a catalyst comprising platinum, or platinum and rhenium, supported on alumina or silica-alumina. A variety of reforming processes are known for this purpose, and are generally employed to produce about a 95 octane number reformate. (As employed herein, unless otherwise noted, "octane number" refers to octane determinations by the research method on unleaded fuel.)

A reformate from a modest-severity reforming operation having a 90–95 octane generally will have about 30–40 vol. % of paraffins, with most of the remainder being aromatics. By virtue of the still-significant paraffin content, the octane of the reformate may be increased significantly by the addition of tetraethyl lead (TEL). However, if governmental regulations prohibit the use of TEL or limit its use to no more than 0.5 ml/gallon, alternative means must be sought to improve the octane of this motor fuel component to produce high octane fuels.

If a reformate of higher octane is desired, e.g., 100 or higher, the severity of the reforming must be increased. This may be accomplished by reducing the space velocity, and/or increasing the reaction temperature, especially the temperature in the terminal reactor (of a train of 3–5 reactors) to increase the hydro-cracking of paraffins to molecules containing less than five carbon atoms and forming aromatics by dehydrocyclization of paraffins. Since the paraffins have a lower octane than the remainder of the gasoline boiling portion of the process stream, cracking such paraffins to $C_1$–$C_4$ molecules tends to raise the octane of the gasoline-range portion of the remaining stream. Dehydrocyclization of paraffins not only eliminates paraffins but has the additional advantage of creating aromatic molecules, which are known for their high octane. It is advantageous also to reduce the reaction pressure in order to increase the ratio of dehydrocyclization to hydro-cracking.

Increasing the severity of reforming has known disadvantages. It reduces the yield of motor fuel reformate as a percent of the naphtha feed-stock. The value of the $C_1$–$C_3$ molecules resulting from the cracking reaction is relatively low, since they are typically left in the by-product hydrogen-rich gas, where their value is essentially no more than the fuel value (in B.T.U.s) of residual fuel. Further, their presence reduces the hydrogen content of the gas, generally to less than 90% and sometimes to about 80%, thereby reducing the value of that gas stream for subsequent use in the manufacture of petrochemicals. In particular, the decreased reaction pressure and space velocities and increased reaction temperatures cause a much more rapid accumulation of hydrocarbonaceous deposits (known as coke) on the catalyst, thus rapidly decreasing the activity of the catalyst and requiring frequent regeneration of it by shutting down one or more reactors and burning off the accumulated coke. Although a high severity reforming operation to produce a motor fuel reformate of over 100 octane is feasible, it often requires regenerating the terminal reactor after merely 24–120 hours of reaction time. Providing the additional equipment, such as extra reactors, extra catalyst inventory, piping, valves, etc., for such a high severity operation substantially increases the capital and operating costs per unit of motor fuel reformate produced.

A characteristic of the reforming process is the by-product hydrogen-rich gas stream, which represents a net production of hydrogen derived primarily from the dehydrogenation of naphthenes. This stream is often employed elsewhere in a refinery such as in hydrocracking gas oil or in furnaces for fuel, or, if sufficiently pure, in the manufacture of chemicals. It is not suitable for use as a town (or city) gas or as a replacement for natural gas, because of its relatively low heating value per cubic foot and its increased explosion hazard. There is, however, an increasing demand for natural gas to be employed for residential domestic purposes and this at a time when there is a decreasing supply of heretofore very low-priced natural gas.

Processes are known for producing town gas having about 500 B.T.U. per cubic foot or a manufactured gas having a heating value of about 900 B.T.U. per cubic foot, intermediate between town gas and natural gas. These processes involve steam reforming of naphtha, as described in Kirk-Othmer's "Encyclopedia of Chemical Technology", volume 10, pages 404 et seq. (second edition, 1966) and various publications of the Institute of Gas Technology and the British Gas Council. The specifications recommended by the British Gas Council for naphtha to be employed for steam reforming include a limitation of not more than 10% aromatics; and sulphur-containing compounds totalling not more than 0.1 ppm of sulphur measured as elemental sulphur. Typically, naphtha steam reforming processes require a separate reactor for desulphurizing the naphtha in order to avoid contamination or deactivation of the catalyst employed in the subsequent steam reforming reactors. The steam reforming of naphtha produces a gas containing only about 50–70% methane which is contaminated with substantial amounts of hydrogen and carbon monoxide. Although suitable for use as town gas, a product of such composition is typically treated to increase the methane content or by other means to increase the heating value of the gas supplied to residential domestic consumers.

U.S. Pat. No. 3,395,094 to Weisz describes a "selectoforming" process intended to produce an aromatic motor fuel liquid product and a gaseous product rich in LPG (light petroleum gas), and asserts that a methane-rich gaseous product useful as consumer gas or city gas may optionally be produced in lieu of the LPG-rich product. The process described in the patent differs from that described herein. The Weisz process employs a type A platinum reforming catalyst, and a type B catalyst which is shape-selective and is typically a zeolite or molecular sieve having uniform pore openings of about 4–5 Angstroms. The type B catalyst is characterized by admitting into its pores only normal paraffins (thus excluding iso-paraffins), and cracking the normal paraffins, preferably to produce propane and butanes rather than methane. Although the Weisz patent refers to the possibility of producing a methane-rich off-gas from the reforming reaction, it does not disclose how to accomplish this. If the Weisz process were actually to be operated with an intent to produce a relatively methane-rich off-gas (taken via line 28), the hydrogen concentration of the off-gas would be so low that the gas taken via line 26 from the separator would not be suitable for recycling via line 24 to the reforming reactors, and hence an auxiliary source of hydrogen would be required. Even if this disadvantage were to be accepted, the relatively methane-rich off-gas would nonetheless have a hydrogen concentration in excess of 10 percent and would not comprise a synthetic natural gas. Indeed, Weisz recognizes this, because he characterizes the relatively methane-rich off-gas as useful merely as a "consumer gas or city gas". Unlike the process described herein, the Weisz process cannot produce a hydrogen-rich off-gas stream as well as a methane-rich stream. Furthermore, the Weisz patent teaches, and the process requires, a high-severity reforming reaction in order to produce a product of sufficiently high octane. Weisz' process does not subject the reformate to a catalytic conversion step at a point down stream from the separator following the last reforming reactor.

U.S. Pat. No. 3,625,664 to Padovani describes a process of making a purported synthetic natural gas from a light naphtha (164°–241° F boiling range) but does not produce any high octane motor fuel blending stock.

Accordingly, it is an object of this invention to provide a combined process for manufacturing a motor fuel blending stock of high octane, typically above 100 octane, and concurrently a synthetic natural gas.

Another object is to produce a high octane blending stock and synthetic natural gas in a combination process in a plant of lower capital costs and lower operating costs than if the same products, of equal quality and amount, were produced from separate naphtha streams charged to separate plants for the separate production of such products.

A further object is to provide a process for producing such products which provides greater flexibility in balancing an increased amount of synthetic natural gas produced against a decreased amount of motor fuel blending stock of higher octane, or a lesser amount of synthetic natural gas against an increased amount of blending stock of reduced octane.

Broadly stated, the process of this invention produces synthetic natural gas and a motor fuel blending stock component having a high unleaded research octane number by first catalytically reforming in a reforming reaction zone a naphtha feed-stock containing naphthenes. The reforming is done in the presence of hydrogen and a catalyst comprising platinum on a refractory inorganic oxide support. Low severity reforming conditions are employed to maximize the formation of aromatics and hydrogen by dehydrogenation of naphthenes and to minimize hydro-cracking of paraffins in the naphtha feed-stock.

The effluent from the reforming reaction zone is cooled and separated in a first separation zone into a hydrogen-rich gas stream and a liquid low octane reformate, the latter comprising predominantly aromatics and paraffins and less than about 10% naphthenes and having an octane number of less than about 95. The low octane reformate stripped of any hydrogen sulfide if significant amounts (more than about 5 pmm) are present, is thereafter introduced without removal therefrom of any organic sulphur-containing comounds, into a methanation zone and into contact with a non-acidic methanation catalyst in the presence of hydrogen. The effluent from the methanation zone is separated, in a second separation zone, into a high-octane motor fuel blending stock component comprising a higher percentage of aromatics than existed in the low octane reformate introduced into such methanation zone, and a synthetic natural gas stream comprising essentially methane and less than about 5% hydrocarbons having more than one carbon atom per molecule and less than about 10% hydrogen.

As employed herein, the term "methanation zone" refers to a zone in which non-aromatic hydrocarbons are converted to methane in the presence of a methanation catalyst, referred to hereinafter, and also in the presence of hydrogen and/or steam. Methanation is distinguished from hydro-cracking because the latter process produces relatively more molecules containing two or more carbon atoms per molecule, rather than methane.

In one embodiment of the invention, all of the hydrogen required in the methanation zone is supplied by the net production of hydrogen-rich gas produced in the re-forming zone. In an alternative embodiment, steam is introduced into the methanation zone and reacts, under the conditions there existing, to form hydrogen to supply a part or all of the hydrogen requirements for the methanation process.

Figure 2:
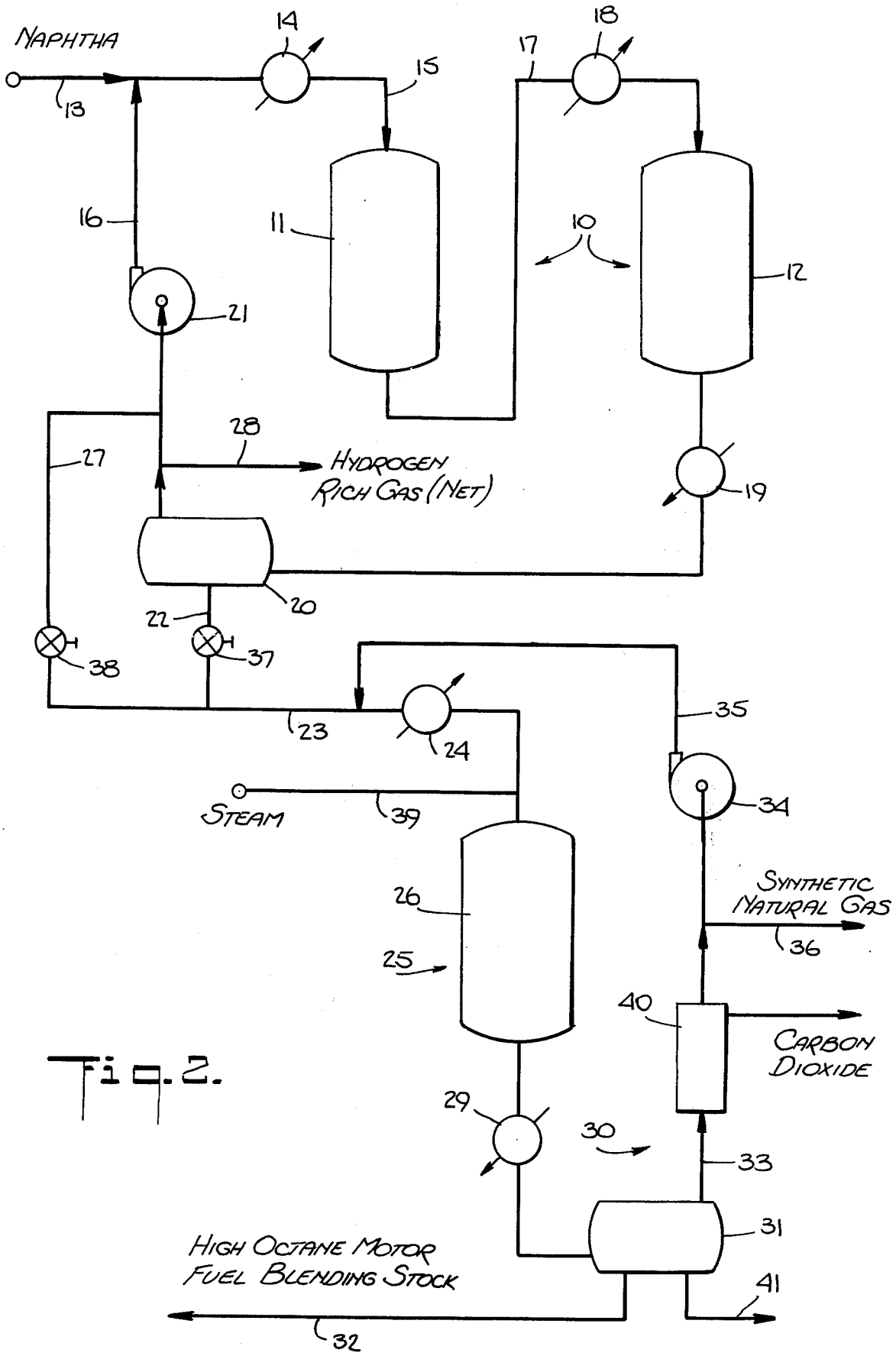

Additional procedural details of the process are developed in the following paragraphs, with reference to the drawings, of which:

FIG. 1 is a simplified schematic flow-sheet of a first embodiment of the process; and FIG. 2 is a similar flow-sheet of a second embodiment of the process, in which steam is introduced into the methanation reaction zone.

Referring now to FIG. 1, a reforming reaction zone 10 comprises two fixed bed reactors, lead reactor 11 and terminal reactor 12, operated in series. (A third or fourth reactor, not shown, may be employed if desired.) Reactors 11 and 12 contain a reforming catalyst described hereinafter. A naphtha feed-stock is supplied via line 13 through heater 14 and line 15 into reactor 11. Recycled hydrogen-rich gas is supplied from line 16 and admixed with the naphtha.

The effluent from reactor 11 is transferred through line 17 to the inlet of reactor 12, being re-heated by heater 18. The gasoline boiling range hydrocarbons in the effluent from terminal reactor 12 are condensed in condenser 19 and transferred to a first separation zone comprising separator 20, in which a hydrogen-rich gas is separated from liquid low octane reformate.

The low octane reformate is transferred from separator 20 via lines 22, 23 through heater 24 to the inlet of the methanation zone 25 comprising one or more methanation reactors 26, shown schematically as a single reactor.

A portion of the hydrogen-rich gas stream from separator 20 is admixed with the naphtha feed-stock by means of compressor 21 and line 16. A portion or all of the net hydrogen gas produced is transferred via line 27 and admixed with the low octane reformate in line 23. The net excess of hydrogen, if any, not required for the methanation zone is discharged from the system via line 28.

The gasoline boiling range hydrocarbons in the effluent from methanation reactor 26 are condensed in condensor 29 and the total effluent introduced into a second separation zone 30 comprising separator 31, from which a liquid high octane motor fuel blending stock is withdrawn via line 32. Synthetic natural gas is withdrawn via line 33; a portion thereof may be optionally recycled to the methanation reactor via compressor 34 and line 35. The net production of synthetic natural gas is discharged from the system via line 36.

Considering in greater detail the pertinent process conditions, the naphtha feed-stock for the process may be any type of naphtha typically employed in prior art reforming processes and is generally a virgin naphtha. If a highly olefinic naphtha is employed, for instance, a catalytic naphtha or thermal naphtha obtained from other processing in a refinery, it is advantageous to hydro-treat it before introducing it into lead reactor 11. Normally the naphtha feed-stock will have a boiling range within the boiling range of gasoline, e.g., 150° F-350° F. However, it is an advantage of this invention that a feed-stock may be employed having a higher end-point, up to about 500° F, as a result of low inlet temperatures employed in the reforming zone, as a consequence of which high boiling components in the feed-stock have a lesser tendency to accumulate coke deposits on the reforming catalyst, and the ability to eliminate in the methanation zone later in the process unreacted high boiling paraffins having an exceptionally low octane number. In the event a high end-point naphtha is employed as a feed-stock, the product high octane motor fuel blending stock should be distilled to eliminate from it aromatics boiling above the gasoline range, which aromatics may be employed as components of industrial solvents or in a petrochemical process, such as the manufacture of naphthalene.

The chemical composition of the naphtha feed-stock may vary widely, depending upon the crude oil from which it was obtained. It is preferred to have a naphtha having a high naphthene content.

The reforming catalyst to be employed in reactors 11 and 12 comprises a minor amount of platinum on a refractory inorganic oxide support, preferably alumina. The amount of platinum is small, normally in the range of about 0.1-3 weight percent of the total catalyst, advantageously about 0.5-0.6 weight percent. The catalyst may also contain a minor amount of rhenium in addition to the platinum and in this event, about 0.3 weight percent of each metal may be employed. Catalysts known in the art comprising platinum and iridium or platinum and germanium on alumina, may also be employed. The catalyst may also include a minor amount of halides, especially chloride.

The reforming process conditions are selected to maximize the dehydrogenation of naphthenes to aromatics and to minimize hydro-cracking of the naphtha. To this end, low-severity reforming conditions are employed. The reforming reaction pressure should be in the range of about 50 to about 500 psig, preferably not more than about 350 psig. The inlet temperature of the stream in line 15 entering lead reactor 11 should be low, preferably below 900° F and advantageously in the range of about 800°-830° F. Since the deyhdrogenation reaction is endothermic and the inlet temperature of the reaction mixture to each successive catalyst reactor in series may be 10°-30° F greater than the inlet temperature to the preceding reactor, inter-reactor heaters such as heater 18 are employed to re-heat the reaction stream. The inlet temperature to the terminal reactor is less than 925° F, and preferably less than 900° F, e.g., 880°-890° F. Low inlet temperatures may be employed when the reforming reaction pressure is at the lower end of the range stated above.

Consistent with the selection of low severity reforming conditions, a high weight hourly space velocity is employed, in the range of about 2-50,. preferably about 5-30 WHSV. The hydrogen to naphtha mol ratio is in the range 1 to 10, preferably in the range of 2-5.

By employing the low severity conditions described herein, the accumulation of coke on the reforming catalyst is sufficiently slow to permit continuous-on-stream use of the catalyst for many months, sometimes exceeding a year, before the catalyst becomes sufficiently deactivated to require regeneration.

The percent of hydrogen in the hydrogen-rich gas stream available in lines 16, 27 and 28 from the first separation zone will vary somewhat depending upon reforming conditions and the percent of naphthenes in the naphta feed-stock, but often is in the range of about 90-98 volume percent, with greater hydrogen purity being associated with an increased percentage of naphthenes in the feed-stock and decreasing re-forming severity. A portion of the hydrogen-rich gas stream is recycled to the inlet of the first reactor in the reforming reaction zone. The net production of hydrogen may be employed in part or entirely in the methanation portion of the process, via line 27, or employed for the manufacture of petrochemicals, or for hydro-cracking or hydrodesulphurization of gas oil, or burned as fuel. An advantage of this invention is that the hydrogen purity of this stream is greater than in reforming processes conducted to produce a reformate suitable for directly blending into motor fuel and is thus a preferred raw material for petrochemical manufacture. Thus, typically an external source of lower purity hydrogen would be utilized for the methanation portion of the process.

The liquid fraction removed from the first separation zone is a low octane reformate having an octane of less than about 95 and generally below 90, sometimes as low as 70-80. The lower octane reformate advantageously should contain at least 35 vol. % aromatics. Unlike other reforming operations, it is a feature of this invention that the reforming process is not controlled to achieve a final product octane in this reformate stream, since the final product octane is determined by the subsequent methanation process. However, the octane is significant because it is related to the amount of saturated hydrocarbons introduced into the methanation zone.

The low octane reformate is re-heated, vaporized and introduced, together with hydrogen-rich gas, into the methanation zone 25. The methanation process is conducted and the process conditions selected to convert the paraffins to methane, until advantageously few paraffins containing more than one carbon atom per molecule remain.

Methanation catalysts suitable for the process include platinum, rhodium, ruthenium, cobalt, nickel, or mixtures thereof, on a solid support. Other noble metals may be employed, such as iridium, palladium, or osmium. The required noble metal content of the methanation catalyst is small, about 0.5%. On the other hand, the nickle content of supported nickel catalysts is much greater, in the range of about 1% up to as high as 90% (as NiO), on alumina. With cobalt catalysts, the metal content is also in the range of about 1% to 90%. The preferred content of nickel or cobalt is typically in the range of about 10–40 weight percent. The methanation catalyst, irrespective of the metal employed, preferably should be of the non-acidic type, in order to avoid acidic hydro-cracking. Suitable catalysts for use in the methanation zone include those comprising nickel, cobalt, iron, platinum or palladium, referred to in U.S. Pat. Nos. 3,625,664, or in U.S. Pat. 3,652,457, or the co-precipitated nickel, iron or cobalt catalyst referred to in French Pat. No. 2,110,987. The catalyst may be in the form of pellets, spheres, beads, a fluidizable powder, or a monolith, advantageously a cross-flow monolith. The type of methanation reactor to be employed depends upon the type and form (shape) of catalyst selected.

The methanation reaction may be conducted in fixed-bed reactors, moving bed reactors or fluidized catalyst reactors, and the process conditions employed depend in part upon the type of reactor system adopted. Reactor 26 schematically represents any of the foregoing types.

The inlet temperature of the process stream entering the methanation zone is typically in the range of about 500° F up to 900° F. Since the methanation reaction proceeds rapidly and is highly exothermic, the temperature within the reaction zone will be greater, in the range of about 800° F–1500° F, although temperatures below 1100° F are preferred. Hence, a fluidized bed reactor is advantageous because of the consequent greater ability to control the reaction temperature, thus permitting operation at greater average reaction zone temperatures, and also the increased facility of burning coke from the catalyst in a fluidized system. However, the reaction temperature within certain localized portions of a fixed catalyst bed methanation reactor may be greater than the average temperature in a fluidized catalyst reactor. In order to control the temperature in a fixed bed reactor, internal means are provided to remove the exothermic heat of reaction, as by employing molten salt as a coolant. Coke often accumulates on the catalyst at a rapid rate. A fixed bed of catalyst is regenerated at frequent intervals and, under some circumstances, after only a short on-stream cycle of about 10–20 minutes duration. In this type of system, the fixed bed reactors may be designed in groups of three separate reactors, as in the old Houdry-type fixed bed catalytic cracking units, in which, at any moment in time, one such reactor is on-stream, a second reactor is being purged for regeneration or for return to on-stream processing, and the third reactor is undergoing regeneration.

As an additional means of controlling the rate of reaction and temperature within the methanation reaction zone, synthetic natural gas optionally may be introduced into the methanation zone, via line 35. Since this stream is essentially methane, which does not react further, it serves as a diluent. This optional technique is useful when employing fixed bed reactors. Also, diluent synthetic natural gas is advantageously employed when the methanation reaction pressure is high, in the range of about 1000–1500 psig, to minimize hydrogenation of aromatics.

The methanation reaction pressure may also vary widely, from less than 100 psig to as high as 1500 psig. The lower pressures are preferred when employing fluidized catalyst reactors and the higher pressures preferred with fixed catalyst bed reactors. The higher reaction pressures permit the construction of smaller reactors and associated apparatus but this must be balanced against increasing cost of construction and also the cost of providing and operating another hydrogen gas stream compressor.

If the methanation reaction is conducted at a lower pressure than the reforming reaction, the reduction in pressure on the low octane reforming stream may be accomplished either before or after admixture with a portion of the hydrogen-rich gas stream and/or the reheating and vaporization of the reformate stream. As illustrated in FIG. 1, this is accomplished by appropriate pressure reduction valves 37 and 38 located in low octane reformate line 22 and hydrogen gas line 27. On the other hand, if the methanation reaction is conducted at a greater pressure than the reforming reaction, then valves 37 and 38 are replaced by a pump and a compressor, respectively, not shown.

The weight hourly space velocity employed in the methanation zone is in the range of about 0.1 to 50, preferably in the range of about 0.5 to 10.

The amount of hydrogen required in the methanation zone depends upon the amount of synthetic natural gas desired and the paraffin and naphthene content of the low octane reformate introduced into the methanation zone. A feature of this invention is that the amount of hydrogen so introduced is limited intentionally to the amount of methane intended to be produced, in order that the synthetic natural gas stream have a minimum of hydrogen impurity. In effect, the hydrogen is employed to extinction. A precise determination of the maximum amount of hydrogen which may be utilized may be determined by known stoichiometric calculations, but as an approximation, one mol of hydrogen is required for each mol of methane in the product synthetic natural gas stream. (For non-alkylated naphthenes, one mol of hydrogen is required per carbon atom and, for paraffins containing $n$ carbon atoms, $(n-1)$ mols of hydrogen are required per paraffin molecule.)

Hydrocarbon contaminants in the hydrogen stream introduced into the methanation zone do not adversely affect the process, but should be taken into account in determining the amount of such stream required in the process.

It is feasible, and in fact is an advantage of the invention to be able, to conduct the methanation process with less than the theoretical amount of hydrogen required to convert all of the paraffins to methane and if this is done, the unreacted saturated hydrocarbons appear in the product motor fuel blending stock. This involves the relative economic advantages, depending on variations in market demand, of producing more synthetic natural gas and fewer barrels of blending stock of a given octane against less natural gas and a greater amount of blending stock having a somewhat lower octane.

The effluent from the methanation zone is cooled to about 100° F and separated into its liquid phase and gas phase components. The liquid phase is the product motor fuel blending stock and comprises predominantly aromatic hydrocarbons plus what ever paraffins and naphthenes were not converted to aromatics or methane in the methanation process. If such process is operated to maximize the production of synthetic natural gas, the motor fuel blending stock may comprise over 90% aromatics and have an octane of about 105, including up to 115 octane and greater. Conventional reforming processes have difficulty in producing such high octane blending stocks.

The gas phase removed via line 36 from the second separation zone is synthetic natural gas of pipeline quality and comprises 95–98% methane with the balance comprising hydrogen and small amounts of ethane.

A specific embodiment of the process depicted in FIG. 1 introduces 40,000 barrels per day (B/D) of naphtha into the process via line 13. The naphtha has a 230° F initial boiling point, 259° F 50% point, and a 320° F end point, determined by an ASTM distillation. The sulphur content of the naphtha is less than 1 ppm.

The naphtha and 3.5 mols of recycle gas (recycled via line 16) per mol of naphtha enters reactor 11 via line 15 at 830° F and a presure of 350 psig. The process stream is reheated in heater 18 to a temperature sufficiently high to produce a 92 octane $C_5+$ reformate from separator 20, which is operated at 250 psig. The combined weight hourly space velocity through reactors 11 and 12 is 10.

The liquid process stream (35,000 B/D) from separator 20 is combined with hydrogen recycle gas from line 27, and with a recycle stream of synthetic natural gas from line 35, and reheated. The mixed stream enters reactor 26 at 600° F and 500 psig. The weight hourly space velocity employed in reactor 26 is 0.5. Operating separator 31 at 475 psig, 50,000,000 SCF/D of synthetic natural gas is withdrawn via line 36, and about 30,000 B/D of 100 octane motor fuel blending stock is withdrawn via line 32.

Under some circumstances, the amount of hydrogen in the hydrogen-rich gas stream available for use within the integrated process described herein will be insufficient to supply all of the hydrogen requirements of the methanation zone. This could occur, for instance, where the hydrogen stream is discharged from the system via line 28, because it is economically more valuable for the manufacture of petrochemicals, or where the naphthene content of the naphtha feed-stock is abnormally small and the paraffin content abnormally great, thus resulting in the formation of insufficient hydrogen to satisfy the methanation requirements of the paraffins remaining after re-forming and which are introduced in the methanation zone.

A deficiency in the amount of hydrogen available for use in the methanation zone may be corrected by introducing steam into the zone, preferably admixed with the hydrocarbon stream introduced into such zone. Under the conditions and with the catalyst employed in the methanation process, steam reacts with non-aromatic hydrocarbons to form carbon dioxide, methane and hydrogen along with small amounts of carbon monoxide. FIG. 2 illustrates an embodiment of the invention employing steam in this manner. Steam is introduced into the system from line 39, the amount of steam being sufficient to supply whatever additional hydrogen is required. As a consequence of employing steam, separation zone 30 includes not only separator 31 but also carbon dioxide scrubber 40, which is adapted to remove carbon dioxide from the gas-phase stream withdrawn via line 33 from separator 31. The design of scrubber 40 may be in accordance with carbon dioxide removal units known in the art, for instance, a type employing an ethanolamine or, less desirably, an alkaline inorganic solution, such as a carbonate solution. Condensed water is withdrawn via line 41.

A specific embodiment of the process depicted in FIG. 2 is operated in the manner described above with reference to FIG. 1, except as described in this paragraph. Steam in the amount of 2,000,000 pounds per day is introduced via line 39 into the process stream entering reactor 26. As a consequence, the product synthetic natural gas withdrawn via line 36 is increased to 100,000,000 SCF/D, and the motor fuel blending stock withdrawn via line 32 is reduced to 20,500 B/D, but having an octane number of 105. About 20,000 pounds per hour of carbon dioxide is removed from scrubber 40.

While FIG. 2 depicts an equivalent embodiment to that of FIG. 1, but where steam is added to produce substantially higher quantities of synthetic natural gas and a motor fuel blending stock of much higher octane, it is probable that in many commercially practical operations a lower octane gasoline would be satisfactory and a greater quantity of it would be preferred. Such an adjustment could be made by reducing the reforming severity in the reforming stage, thus lowering the amount of hydrogen produced and utilized in the methanation step.

FIGS. 1 and 2 illustrates only schematically the primary heat exchanging units, i.e., heaters 14, 18 and 24, and condensers 19 and 29. It will be understood by those skilled in the art that the selection of the type of heat exchangers specifically to be employed will depend upon the duty they are to serve, and that each such heat exchanger unit may in fact comprise two or even three different pieces of apparatus which may be of different types of design. For instance, heater 14 may consist of a shell and tube exchanger followed by a furnace, in order to heat the vaporized naphtha and hydrogen-gas stream to the desired inlet temperature for reactor 11. Also, the process stream at one point in the system may be heat exchanged with the process stream at a different point in the system. By virtue of employing an integrated combination process in which the reforming reaction of dehydrogenation is endothermic and the methanation reaction exothermic, a substantial economy of heat is available without resorting to merely manufacturing high pressure steam.

Having thus described the invention, what is claimed is:

1. A process for producing synthetic natural gas and a motor fuel blending stock component having a high unleaded research octane number, which process comprises catalytically reforming in a reforming reaction zone a naphtha feed-stock containing naphthenes by contacting in said zone said naphtha in the vapor phase and in the presence of hydrogen with a reforming catalyst at low severity reforming conditions selected to maximize the formation of aromatics by dehydrogenation of naphthenes and to minimize hydrocracking of components of said feed-stock; cooling the effluent from said reaction zone and separating said effluent in a first separation zone into a hydrogen-rich gas stream and a liquid low octane reformate, said reformate comprising predominantly aromatics and paraffins and less than about 10% naphthenes, and having an octane number of less than about 95; introducing said reformate into a methanation zone for conversion of non-aromatic hydrocarbons to methane and into contact with a methanation catalyst in the presence of hydrogen, and separating in a second separation zone the effluent from said methanation zone into only two streams, said streams being a high octane motor fuel blending stock component comprising predominantly aromatics and having a higher percentage of aromatics than in said low octane reformate and a synthetic natural gas stream comprising essentially, on a carbon dioxide-free basis, methane and less than about 5% hydrocarbons having more than one carbon atom per molecule, and not more than 10% hydrogen.

2. The process of claim 1, wherein said low octane reformate has an octane number of less than 90.

3. The process of claim 1, wherein at least a portion of said hydrogen-rich gas stream from said first separator is introduced into said methanation zone.

4. The process of claim 1, wherein said motor fuel blending component has an octane not less than about 105.

5. The process of claim 1, wherein said low octane reformate comprises at least about 35% aromatics.

6. The process of claim 1, wherein said methanation zone is operated at a temperature in the range of about 600° F to about 1500° F.

7. The process of claim 1, wherein said methanation catalyst comprises nickel, cobalt, platinum, rhodium, or ruthenium, on a solid support.

8. The process of claim 1, wherein steam is introduced into said methanation zone and said second separation zone comprises a carbon dioxide scrubber.

9. The process of claim 8, wherein at least a portion of said hydrogen-rich gas stream is introduced into said methanation zone.

* * * * *

UNITED STATES PATENT AND TRADEMARK OFFICE

CERTIFICATE OF CORRECTION

PATENT NO. : 4,073,716

DATED : February 14, 1978

INVENTOR(S) : PFEFFERLE, et al

It is certified that error appears in the above-identified patent and that said Letters Patent are hereby corrected as shown below:

In Column 1, line 18 "forming" should be --reforming--.

In Column 3, line 67 "pmm" should be --ppm--.

In column 4, line 25 "re-forming" should be --reforming--.

In column 6, line 22 "re-forming" should be --reforming--.

In column 6, line 64 "nickle" should be --nickel--.

Signed and Sealed this

*Third* Day of *April 1979*

[SEAL]

*Attest:*

RUTH C. MASON
*Attesting Officer*

DONALD W. BANNER
*Commissioner of Patents and Trademarks*